US007503147B2

(12) United States Patent
Foss

(10) Patent No.: US 7,503,147 B2
(45) Date of Patent: Mar. 17, 2009

(54) FIBERGLASS CEILING GRID SYSTEM

(76) Inventor: Kenneth R. Foss, W 11853 Hwy. 113, Lodi, WI (US) 53555

( * ) Notice: Subject to any disclaimer, the term of this patent is extended or adjusted under 35 U.S.C. 154(b) by 394 days.

(21) Appl. No.: 11/328,038

(22) Filed: Jan. 9, 2006

(65) Prior Publication Data

US 2007/0157536 A1 Jul. 12, 2007

(51) Int. Cl.

| | |
|---|---|
| ***E04C 2/52*** | (2006.01) |
| ***E04C 2/42*** | (2006.01) |
| ***E04B 2/00*** | (2006.01) |
| ***E04H 12/00*** | (2006.01) |

(52) U.S. Cl. ..... 52/220.6; 52/506.07; 52/665; 52/650.3

(58) Field of Classification Search ..... 52/220.6, 52/506.06, 506.07, 660, 664, 665, 670, 650.3, 52/667, 726.2; 403/305, 286, 292, 293, 298, 403/397

See application file for complete search history.

(56) References Cited

U.S. PATENT DOCUMENTS

| | | | | | |
|---|---|---|---|---|---|
| 3,292,332 | A | * | 12/1966 | Martin | 52/506.07 |
| 3,304,684 | A | * | 2/1967 | Mock et al. | 52/665 |
| 3,321,879 | A | * | 5/1967 | Purdy | 52/232 |
| 3,677,589 | A | * | 7/1972 | Roles | 403/217 |
| 4,559,751 | A | * | 12/1985 | Rogers | 52/665 |
| 4,570,391 | A | * | 2/1986 | Quante et al. | 52/39 |
| 4,580,387 | A | * | 4/1986 | Rogers | 52/665 |
| 4,640,077 | A | * | 2/1987 | Hall | 52/665 |
| 5,154,031 | A | * | 10/1992 | Wall | 52/506.06 |
| 5,325,647 | A | | 7/1994 | Forry et al. | |
| 5,394,669 | A | * | 3/1995 | Hallett et al. | 52/506.07 |
| 5,396,748 | A | | 3/1995 | Rogers | |
| 5,761,868 | A | | 6/1998 | LaLonde et al. | |
| 5,927,036 | A | * | 7/1999 | Matthews et al. | 52/483.1 |
| 5,966,887 | A | | 10/1999 | Mieyal | |
| D422,486 | S | * | 4/2000 | Wolfe et al. | D8/395 |
| 6,199,343 | B1 | | 3/2001 | Sauer et al. | |
| 6,536,173 | B2 | | 3/2003 | Rebman | |
| 6,591,557 | B1 | | 7/2003 | Thomsen et al. | |
| 6,729,100 | B2 | | 5/2004 | Koski et al. | |

(Continued)

OTHER PUBLICATIONS

"Installation Guide Keelgrid® Fiberglass and Plastic Suspended Ceiling Grid System", Keel Manufacturing, Inc., Nov. 1993.

(Continued)

*Primary Examiner*—Richard E Chilcot, Jr.
*Assistant Examiner*—Ryan D Kwiecinski
(74) *Attorney, Agent, or Firm*—Stiennon & Stiennon

(57) ABSTRACT

A suspended ceiling grid system has parallel main runners and perpendicular cross members which are formed of pultruded fiber-reinforced plastic. The main runners have vertical webs with regularly spaced vertical slots. The cross members are connected to each other and to the main runners by resilient extruded PVC cross connectors which pass through the main runner web slots and resiliently engage the ends of the cross members. The cross connectors have a horizontal element which is received within horizontal slots in the ends of the cross members, and two vertical elements which engage the cross member webs therebetween. The main runners are supported by overhead hanger wires. Ceiling tiles are received on horizontal flanges of the connected main runners and cross members. The connectors may be attached without tools for convenient assembly of the system.

18 Claims, 3 Drawing Sheets

U.S. PATENT DOCUMENTS

| | | | | |
|---|---|---|---|---|
| 6,843,033 | B2 | 1/2005 | Okumura | |
| 6,851,238 | B2 | 2/2005 | Rebman | |
| 2005/0160696 | A1 * | 7/2005 | Kelly et al. | 52/712 |
| 2007/0130869 | A1 * | 6/2007 | Platt | 52/506.08 |
| 2007/0157536 | A1 * | 7/2007 | Foss | 52/506.07 |
| 2007/0175152 | A1 * | 8/2007 | Kupec et al. | 52/506.07 |

OTHER PUBLICATIONS

"Sanigrid® II fiberglass ceiling grid system" pamphlet, Kemlite Company, Inc.

"BE-PLAS corrosion resistant FRP Ceiling System", pamphlet.

* cited by examiner

FIBERGLASS CEILING GRID SYSTEM

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to suspended ceiling grid systems in general, and to such systems which are fabricated from non-metallic materials in particular.

In many business office spaces and industrial facilities, electrical, plumbing, and ventilation services are carried overhead, and are concealed by underlying ceilings formed of uniform tiles. The tiles are supported by a framework or grid which is carried on wire hangers which are secured to the overhead supports of the building structure. Such hung or suspended ceilings offer the advantage that temporary openings can be readily formed at any desired location for ready access to wires, pipes, or ducts.

Often the supported gridwork is formed of metal shaped into inverted T-shaped members, which have lower flanges which support the ceiling tiles. These metal systems may have cross members with interlocking ends which pass through slots in the perpendicular main runners to engage with other cross members on the opposite side of the main runners. An alternative to metal grid members is provided by fiber reinforced plastic members, formed by pultrusion, which offer a desirable resistance to corrosion, perform better in humid conditions, are electrically nonconductive, and may offer economical construction. Some prior art systems have employed resilient plastic clips which connect the inverted T-shaped pultruded members. These clips press down from above on the central webs of the grid members, and hence intrude into the space which would be occupied by the tiles. Such systems thus either require non-standard tile dimensions (i.e., other than the conventional nominal 2×2 foot or 2×4 tiles), or else result in grid spacings that are non-standard.

What is a needed is a plastic suspended ceiling grid system which accepts conventionally sized tiles in a conventional spacing arrangement.

SUMMARY OF THE INVENTION

The suspended ceiling grid system of this invention has parallel main runners and perpendicular cross members which are formed of pultruded fiber-reinforced plastic. The main runners have webs which extend upwardly from lower flanges. The main runner webs have regularly spaced vertical slots. The cross members are positioned perpendicularly to the main runners and have webs which extend upwardly from lower flanges. The cross member webs have horizontal slots at each end. The cross members are connected to each other and to the main runners by resilient extruded PVC cross connectors which pass through the main runner web slots and resiliently engage the ends of the cross members. Each cross connector has a horizontal element which is received within the horizontal slots in the ends of the cross members, and two vertical elements which engage the cross member webs therebetween. The main runners are supported by overhead hanger wires. Ceiling tiles are received on horizontal flanges of the connected main runners and cross members. The connectors may be attached without tools for convenient assembly of the system. A resilient wall connector is fastened to a cross member on one end, and has two tabs which extend perpendicular to the cross member web. The tabs engage with and are supported on the base flange of a wall angle member which is fastened to a wall.

It is an object of the present invention to provide a suspended ceiling grid system having plastic members which are conveniently assembled and which accept conventionally dimensioned ceiling tiles.

It is another object of the present invention to provide a suspended ceiling grid system which is economically manufactured.

Further objects, features and advantages of the invention will be apparent from the following detailed description when taken in conjunction with the accompanying drawings.

DESCRIPTION OF THE PREFERRED EMBODIMENTS

Figure 1:
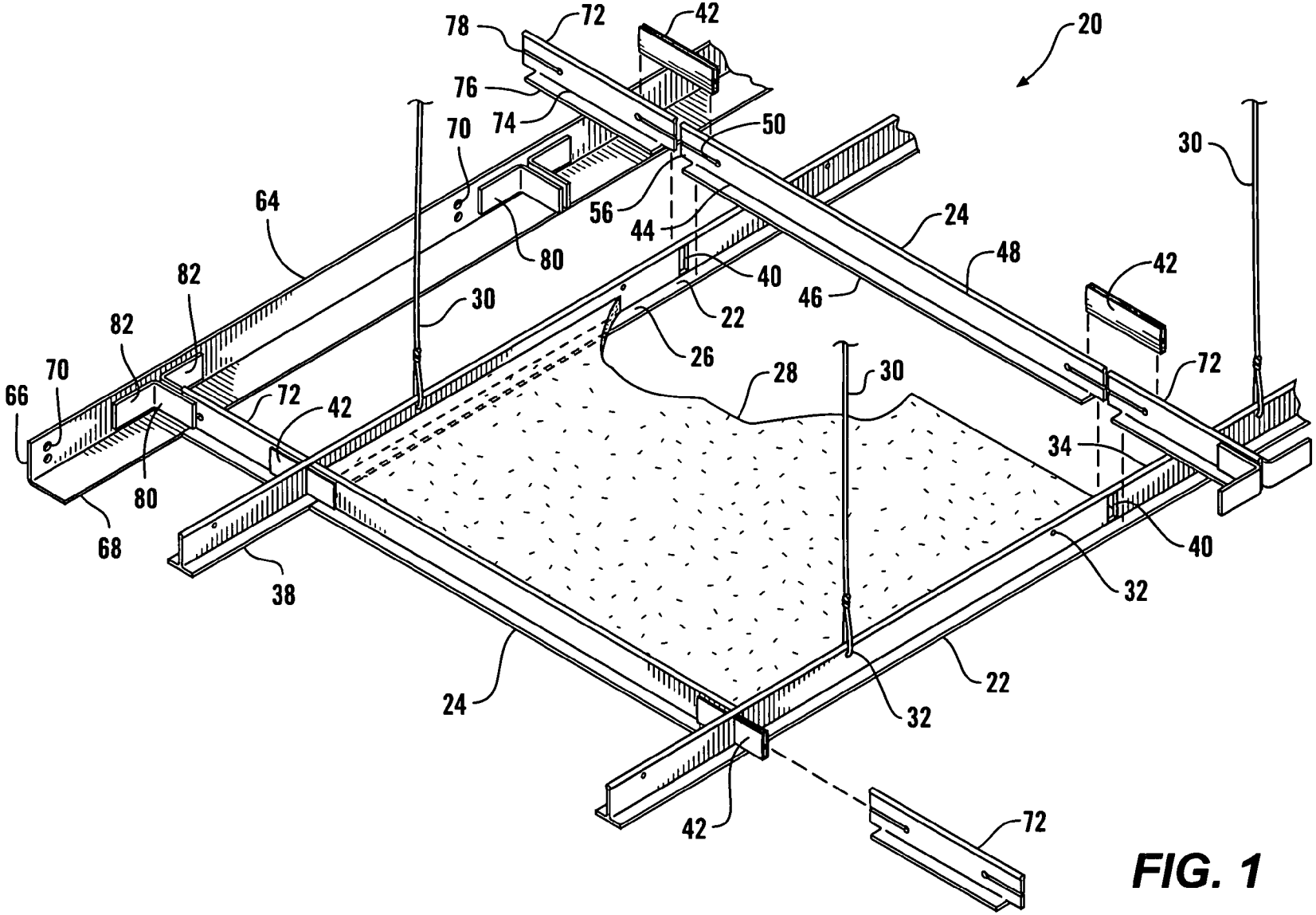
FIG. 1 is an exploded fragmentary isometric view of the ceiling grid system of this invention. For illustrative purposes, the system has been illustrated with ceiling tiles smaller than those commonly used.

Referring more particularly to FIGS. 1-5, wherein like numbers refer to similar parts, a suspended or hung ceiling grid system 20 is shown in FIG. 1. The ceiling grid system 20 is installed in a building structure to be supported from some overhead frame or support, not shown. The ceiling grid system has an array of parallel main runners 22 which are joined to perpendicular cross members 24 to define a grid of rectangular openings 26 within which conventional modular ceiling tiles 28 are received. The main runners 22 are longer than a single ceiling tile, and are suspended from the building structure by hang wires 30 which are looped through evenly spaced wire holes 32 formed in the main runners. The wire holes may be ¼ in diameter, and starting 6 inches from one end of the main runner, then spaced one foot on center. For illustrative purposes, in FIG. 1, smaller ceiling tiles have been illustrated. The conventional ceiling tile is intended for spacing on two-foot centers or 2×4 foot centers), and will usually be ¼ inch less than the spacing to accommodate the web thickness. Hence for two-foot spacing, a tile will be 23 and ¾ inches square, and for 2×4 spacing the tile will be 23.75 inches×47.75 inches.

Figure 2:
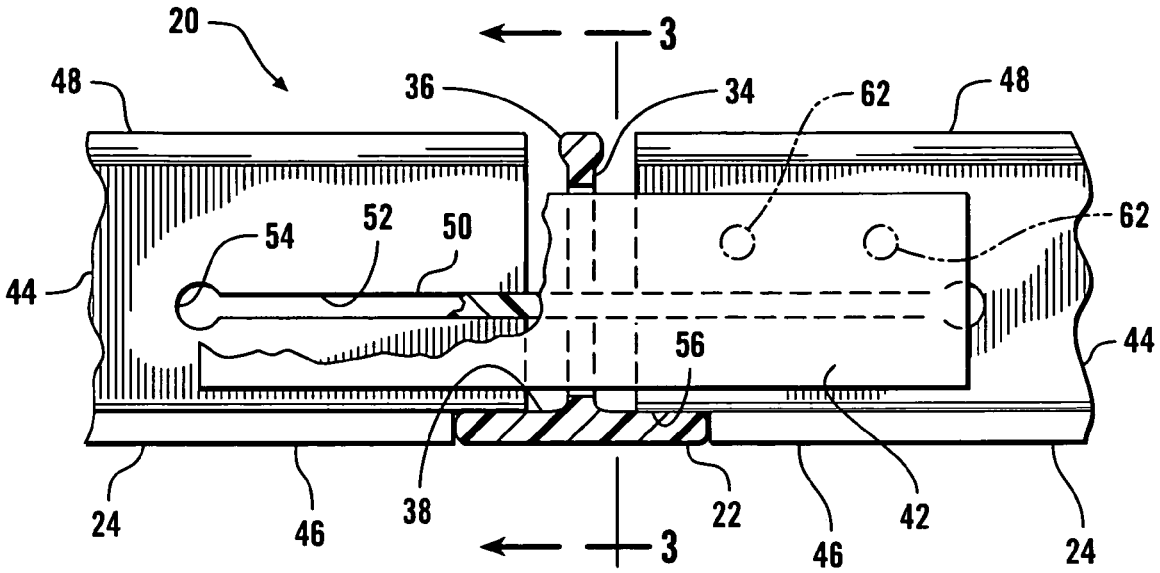
FIG. 2 is a fragmentary cross-sectional view of a portion of the system of FIG. 1.
Figure 3:
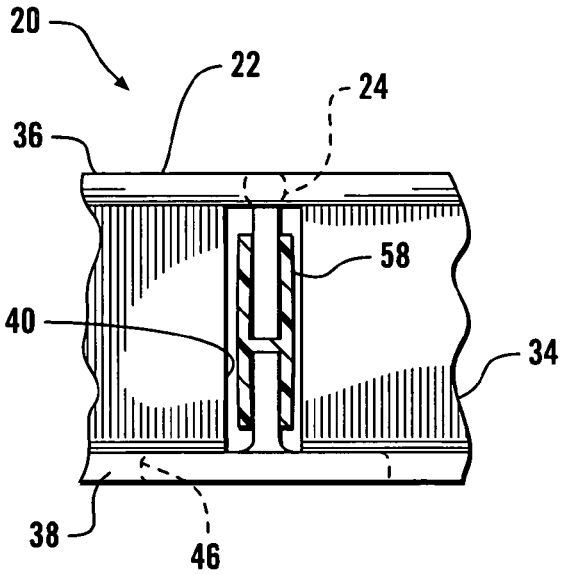
FIG. 3 is a fragmentary cross-sectional view of the system of FIG. 2 taken along section line 3-3.

The main runners 22 and the cross members 24 are reinforced plastic elements, preferably formed by pultrusion. In the pultrusion process, reinforcing fiber strands are pulled through a die which defines the profile of the part, along with a plastic resin. The result is a uniform cross-section element which has fiber reinforcements extending the length of the part. The pultruded parts are preferably fiberglass. Typically the fiberglass will be composed of a plastic class resin, calcium carbonate, may include a fire retardant, and has both short chopped fibers, ¼ to ⅜ inches in length, as well as long fibers that extend the full length of the pultrusion. As best shown in FIGS. 2 and 3, the main runners 22 and cross members 24 may be formed of the same pultruded elements.

As shown in FIG. 2, the main runner 22 has an upwardly extending web 34 which extends from a rounded cap 36 above to an outwardly extending flange 38 below. length by upwardly extending rectangular slots 40. For example, the first slot may be one foot from the end of the main runner, with the remaining slots spaced 2 feet on center. The slots may be approximately ¼ by ⅞ inches. The slots 40 extend from above the flange 38 to below the cap 36, and provide clearance for resilient plastic connectors 42, as shown in FIG. 3. In a preferred embodiment to accommodate conventional modular ceiling tiles which are spaced two feet on center, the main runner has a height of about 1 ⅛ inches, a web thickness of about 0.1 inches, and a flange width of about 1 inch. The main runner may be fabricated in lengths of about twelve feet. Multiple main runners may be connected to span greater ceiling distances by forming slots in the ends of the main runners and using the connectors 42 as will be described with respect to the cross members below.

Each cross member 24 has a web 44 which extends upwardly from a flange 46 to a cap 48. The cross member section, shown in FIG. 3, is generally of the same dimensions as that of the main runner 22, however, the pultruded element is machined differently than the main runner. Each cross member 24 is shorter than a main runner 22, and is cut to a length to space two parallel main runners sufficiently to receive a ceiling tile therebetween, and to support the ceiling tile on the flanges of the cross members and main runners that define a tile receiving opening 26. To accept common modular tiles, the length of the cross members 24 is somewhat less than two feet or four feet. As shown in FIG. 2, a horizontal end slot 50 is formed in each of the two ends of each cross member 24. The end slots are positioned midway up the web 44 and have a straight linear segment 52 of a constant height, for example about 1/10 inch. Each slot is terminated by an approximately circular opening 54 which is greater than the height of the slot linear segment. The end slots may be formed by milling or routing, and may be formed in an automated fixture by the manufacturer, or may be formed in the field by an installer, for example when a shortened cross member is required because of a particular ceiling's dimensions.

To allow the cross member webs to extend into proximity with the main runner web, and to allow the cross member flanges to abut or come close to abutting the main runner flanges, portions of the cross member flanges are milled away at each end of the cross member, as best shown in FIG. 2. Thus a free end portion 56 of the cross member web 44 protrudes from the flange 46 such that it may extend over portions of the flange 38 of the main runner to which it is connected.

Figure 4:
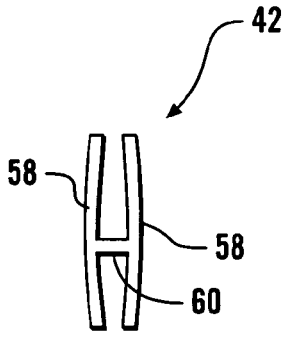
FIG. 4 is a cross-sectional view of the connector of the system of FIG. 3.

The connectors 42, as best shown in FIGS. 3 and 4, are preferably formed of extruded PVC, for example, grade I, type 2, and are thus resilient. Each connector 42 has a uniform cross section, with two upwardly extending side elements 58 which are connected at a midpoint by a horizontal element 60 in a generally H-shaped configuration. The side elements 58 are arc segments, and are most widely spaced from one another at the horizontal element 60. The horizontal element 60 is positioned closer to the bottom of the connector than to the top. Because the side elements 58 are curved, it will be noted that the gap between the side elements is smaller at the outside of the connector than at the horizontal element 60, in the as-formed condition. The spacing between the side elements at its narrowest is less than the thickness of the cross member web 44. Therefore, when the connector 42 is affixed to the end of a cross member, as shown in FIG. 2, the connector horizontal element 60 is received within the end slot 50, and the side elements 58 are deformed to extend on either side of the cross member 24 web 44 and to resiliently engage the web to the connector. The connector 42 may be advanced into the end slot until the horizontal element 60 extends into the circular portion 54 of the end slot 50. As shown in phantom view in FIG. 2, the connectors 42 may be permanently fixed to the cross members by one or more pop rivets 62, although these rivets are not required. Alternatively, a silicone adhesive may be used to permanently fix the cross members in place of the pop rivets.

Figure 5:
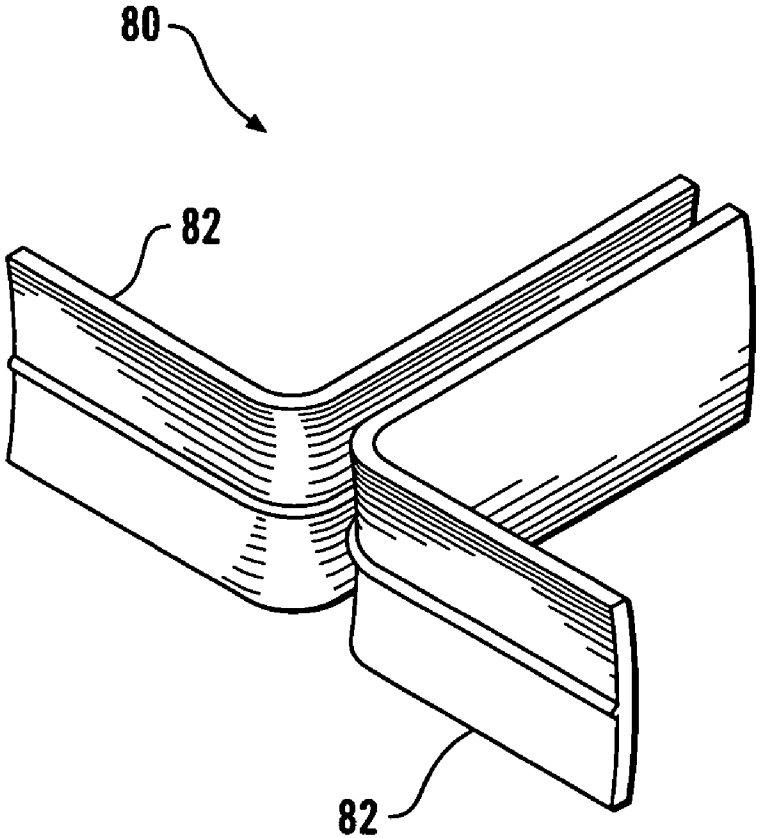
FIG. 5 is an isometric view of a wall side connector of the system of FIG. 1.

As shown in FIG. 1, the cross members 24 are connected to each other, and to the main runners 22, by the connectors 42 which extend through the slots 40 in main runner webs 34. The ceiling grid system 20 is installed by first fastening wall angle members 64 to the walls of the room at the desired ceiling height. As shown in FIG. 1, the wall angle members are pultruded reinforced plastic members which have a vertical wall flange 66 which extends upwardly from a horizontally extending base flange 68. The wall flange 66 is preferably provided with fastening holes 70 to facilitate the screw mounting of the wall angle member to the wall. Next hang wires 30 are affixed to the building structure at regular intervals and the main runners 22 are hung from the hang wires spaced in parallel at intervals to accommodate the dimensions of the ceiling tiles. As the ceiling dimensions will commonly not be exact multiples of the ceiling tile dimension, the installer must cut to length side cross members 72 to extend from the last main runner to the wall angle member. The members may be cut with a rotary cutting tool such as a Dremel® rotary tool, or with a hacksaw. The webs 74 of the side cross members 72 are trimmed to length, and the flanges 76 cut away so a portion 78 of the web extends over the base flange 68 of the wall angle member. The side cross members 72 are installed by mounting one end to the last main runner 22 with a connector 42 which extends through the slot 40 and which connects to a cross member 24. The end of the side cross member 72 which engages the wall angle member 64 is resiliently engaged by a wall connector 80 which is formed from an extrusion identical to the connector 42. However, as shown in FIG. 5, the wall connector 80 is slit vertically through the horizontal element 60 for half its length, and then the vertical elements are folded sidewardly to define two tabs 82 extending at 180 degrees to each other and 90 degrees to the web of the side cross member. The tabs 82 overlie and are supported by the wall angle member base flange 68.

Working from main runner to main runner, additional cross members are added as needed. Ceiling tiles are then placed in the openings 28 thus formed.

It is understood that the invention is not limited to the particular construction and arrangement of parts herein illustrated and described, but embraces all such modified forms thereof as come within the scope of the following claims.

I claim:

1. A ceiling grid system comprising:

a main runner extending in a first direction, the main runner having a web which extends upwardly from an outwardly extending flange, wherein portions of the main runner define an upwardly extending slot extending through the main runner web;

a first cross member and a second cross member, each cross member having a web which extends upwardly from an outwardly extending flange; and a connector which passes through the main runner web slot, the connector resiliently gripping the webs of the first cross member and the second cross member to connect the first cross member and the second cross member to extend on opposite sides of the main runner web, wherein each cross member web extends in a second direction generally perpendicular to the first direction, and wherein portions of each cross member web define an end slot which extends in the second direction, the end slot being positioned above the cross member flange; and wherein the connector is a plastic extrusion of uniform cross section, the connector having two upwardly extending elements connected at a midpoint by a horizontal element, portions of the horizontal element being received within the end slots of the connected first cross member and second cross member such that portions of the webs of the first cross member and the second cross member are engaged between the two connector upwardly extending elements.

2. The ceiling grid system of claim 1 wherein each cross member slot has a straight portion of a constant height, and is terminated by an approximately circular opening with a diameter which is greater than the constant height.

3. The ceiling grid system of claim 1 wherein the second cross member has portions defining a wall side end slot spaced from the end slot which engages the connector, and further comprising:

a wall angle member having a wall flange which extends upwardly from a base flange which extends horizontally; and a wall connector which engages with the wall side end slot, the wall connector having a first part which engages the second cross member and which extends generally in the second direction, and two tabs which extend from the first part in the first direction to overlie and be supported by the wall angle member base flange.

4. The ceiling grid system of claim 1 further comprising a ceiling tile which engages the flange of the main runner and the flange of the cross member.

5. The ceiling grid system of claim 1 further comprising at least one rivet which fastens the connector to the first cross member.

6. The ceiling grid system of claim 1 further comprising silicone adhesive which fastens the connector to the first cross member.

7. The ceiling grid system of claim 1 wherein the webs of the first cross member and the second cross member each extend toward the web of the main runner to which they are connected, the cross member webs protruding from the cross member flanges, such that portions of the cross member webs extend over portions of the main runner flange.

8. A ceiling grid system comprising:

a plurality of main runners extending in a first direction, each main runner having a web which extends upwardly from an outwardly extending flange to an upper cap, wherein portions of each main runner define a plurality of upwardly extending slots which extend through the main runner web, the slots being positioned beneath the cap and above the flange, and being spaced from one another in the first direction;

a plurality of first cross members and second cross members, each cross member having a web which extends upwardly from an outwardly extending flange, the cross members extending in a second direction which is perpendicular to the first direction; and a plurality of connectors which pass through the main runner web slots beneath the cap, each connector having spaced upwardly extending elements connected at a midpoint by a horizontal element, the upwardly extending elements engaging therebetween the web of one of the first cross members and the web of one of the second cross members, each of said webs being thus positioned between two upwardly extending elements such that the first cross members are connected to the second cross members to extend on opposite sides of a main runner web, such that a plurality of cross members extend between two parallel main runners.

9. The ceiling grid system of claim 8 wherein each cross member web has portions defining a slot which extends in the second direction, and wherein each connector horizontal element is engaged with one of said slots.

10. The ceiling grid system of claim 8 wherein portions of each cross member web define an end slot which extends in the second direction, the end slot being positioned above the cross member flange.

11. The ceiling grid system of claim 10 wherein each cross member slot has a straight portion of a constant height, and is terminated by an approximately circular opening with a diameter which is greater than the constant height.

12. The ceiling grid system of claim 8 wherein the connector is a plastic extrusion of uniform cross section which resiliently engages the cross members.

13. The ceiling grid system of claim 8 wherein the second cross members have portions defining a wall side end slot spaced from an end slot which engages the connector, and further comprising:

a wall angle member having a wall flange which extends upwardly from a base flange which extends horizontally; and a plurality of wall connectors which engage with the wall side end slots, each wall connector having a first part which engages the second cross member and which extends generally in the second direction, and two tabs which extend from the first part in the first direction to overlie and be supported by the wall angle member base flange.

14. The ceiling grid system of claim 8 further comprising a plurality of ceiling tiles which each engage the flanges of two main runners and the flanges of two cross members.

15. The ceiling grid system of claim 8 further comprising at least one rivet which fastens one of the connectors to one of the first cross members.

16. The ceiling grid system of claim 8 further comprising silicone adhesive which fastens one of the connectors to one of the first cross members.

17. The ceiling grid system of claim 8 wherein the webs of the first cross members and the second cross members each extend toward the web of the main runner to which they are connected, the cross member webs protruding from the cross member flanges, such that portions of the cross member webs extend over portions of the main runner flange.

18. A ceiling grid system comprising:

a pultruded main runner extending in a first direction, the main runner having a web which extends upwardly from an outwardly extending flange to a top cap, wherein portions of the main runner define an upwardly extending slot extending through the main runner web, the slot being positioned above the flange and beneath the cap;

a pultruded first cross member and a pultruded second cross member, each cross member having a web which extends upwardly from an outwardly extending flange;

a resilient connector of constant cross section which passes through the main runner web slot, the connector resiliently gripping the webs of the first cross member and the second cross member to connect the first cross member and the second cross member to extend on opposite sides of the main runner web; and a ceiling tile supported on the flange of the first cross member and the flange of the main runner.

* * * * *